US007824023B2

(12) United States Patent
Izawa et al.

(10) Patent No.: US 7,824,023 B2
(45) Date of Patent: Nov. 2, 2010

(54) INK FURNISHING UNIT IN AN INK JET RECORDER

(75) Inventors: Hideo Izawa, Narashino (JP); Takao Namiki, Narashino (JP); Akira Ishikawa, Narashino (JP); Junichi Setoyama, Narashino (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 500 days.

(21) Appl. No.: 11/921,819

(22) PCT Filed: Jun. 12, 2006

(86) PCT No.: PCT/JP2006/312198

§ 371 (c)(1),
(2), (4) Date: Dec. 7, 2007

(87) PCT Pub. No.: WO2006/135077

PCT Pub. Date: Dec. 21, 2006

(65) Prior Publication Data

US 2009/0046132 A1 Feb. 19, 2009

(30) Foreign Application Priority Data

Jun. 13, 2005 (JP) ..... 2005-172012

(51) Int. Cl.
*B41J 2/175* (2006.01)

(52) U.S. Cl. ..... 347/85; 347/92; 347/17

(58) Field of Classification Search ..... 347/85, 347/92, 16, 17, 22
See application file for complete search history.

(56) References Cited

U.S. PATENT DOCUMENTS

| | | | | |
|---|---|---|---|---|
| 6,561,637 | B2 * | 5/2003 | Hino | 347/92 |
| 7,261,399 | B2 * | 8/2007 | Miki | 347/85 |
| 2001/0028374 | A1 * | 10/2001 | Ogawa et al. | 347/35 |
| 2004/0189742 | A1 * | 9/2004 | Kimura et al. | 347/33 |
| 2005/0078144 | A1 * | 4/2005 | Yamada et al. | 347/30 |
| 2005/0179755 | A1 * | 8/2005 | Murakami et al. | 347/86 |
| 2009/0284563 | A1 * | 11/2009 | Bansyo | 347/19 |

FOREIGN PATENT DOCUMENTS

JP 56-167485 12/1981

(Continued)

*Primary Examiner*—Ellen Kim
(74) *Attorney, Agent, or Firm*—Cohen Pontani Lieberman & Pavane LLP

(57) ABSTRACT

It is desirable that the entire ink to be furnished to the nozzle head be deaerated efficiently, the entire ink including a portion of ink recovered from the purge section.

Accordingly, an ink furnishing unit in an ink jet recorder is provided, which comprises a back pressure tank 15 connected to a nozzle head 2 via an ink supply passage, a main tank 9 connected to the back pressure tank via a main supply passage 16 provided with a main ink pump 18 therein, a recovery tank 7 connected to the main tank via a return passage provided with an ink pump 22 therein, and a purge cap 5 connected to the recovery tank via a recovery passage 8 provided with a purge pump 6 therein, the purge cap being opposed to the nozzle head when purging, wherein a deaerator 17 is disposed in the main supply passage connecting the main tank and the back pressure tank and the back pressure tank is connected to an upstream of the purge pump in the recovery passage via a three way directional control valve 30.

4 Claims, 2 Drawing Sheets

FOREIGN PATENT DOCUMENTS

| | | |
|---|---|---|
| JP | 11-48491 | 2/1999 |
| JP | 2001-315357 | 11/2001 |
| JP | 2002-103644 | 4/2002 |
| JP | 2002-086763 | 3/2003 |
| JP | 2003-127435 | 5/2003 |
| JP | 2003-341029 | 12/2003 |
| WO | WO 01/72522 | 10/2001 |

* cited by examiner

INK FURNISHING UNIT IN AN INK JET RECORDER

RELATED APPLICATIONS

This is a U.S. National Phase Application under 35 USC 371 of International Application PCT/JP2006/312198 filed on Jun. 12, 2006.

This application claims the priority of Japanese application no. 2005-172012 filed Jun. 13, 2005, the entire content of which is hereby incorporated by reference.

TECHNICAL FIELD

The present invention relates to an ink furnishing unit for supplying a nozzle head with ink in an ink jet recorder.

BACKGROUND ART

In the supply of ink into the nozzle head in an ink jet recorder, it is necessary that pressure of the ink be maintained constant and air bubbles be not mixed in the ink. As a matter of fact, however, it is said that the concentration of air (oxygen) dissolved in the ink in the state that the ink is only exposed to the air is increased to 5 to 6 ppm from 1 ppm for a period of 30 minutes. And, the entrained air accumulates at such as a bent area in the piping to become air bubbles which in the nozzle head cause an undischarge of ink or a fluctuation in ink pressure which in turn brings about a poor or defective printing.

Accordingly, the ink furnishing unit of this type in the prior art includes a deaerator that is provided for a recovery tank which reserves the ink recovered from the purge section and abounding with air bubble (see, for example, JP P2003-127435 A) or a deaerator that is disposed midway in the ink supply circuit (see, for example, JP P2004-17517 A).

In the technique shown in JP P2003-127435 A and designed to permit recycling the ink recovered at the purge section, it is difficult to deaerate the entire recovery tank uniformly so that it has not been possible to remove air bubbles completely from the ink in the recovery tank.

While in this regard the technique shown in JP P2004-17517 A permits the entire volume of ink furnished from the supply tank into the main tank to be evenly deaerated only by passing through its piping, this techniques does not allow such ink to be directly furnished to the nozzle head. Since the ink is once stored in the air-open main tank for stabilization of its supply pressure and then is furnished to the nozzle head, the amount of air entrained in the ink while in the main tank increases with the lapse of time, causing the problem that the ink discharge at the nozzle head tends to be defective.

With these taken into account, it is an object of the present invention to provide an ink furnishing unit in an ink jet recorder that can efficiently deaerate the ink furnished to the nozzle head including the ink recovered from the purge section so that the defective printing due to the mixing of air bubbles in the ink may be prevented.

DISCLOSURE OF THE INVENTION

In order to achieve the object mentioned above, there is provided in accordance with the present invention in a first form of implementation thereof an ink furnishing unit in an ink jet recorder, comprising: a back pressure tank connected to a nozzle head via an ink supply passage, a main tank connected to the back pressure tank via a main supply passage provided with a main ink pump therein, a recovery tank connected to the main tank via a return passage provided with an ink pump therein and a purge cap connected to the recovery tank via a recovery passage provided with a purge pump therein, the purge cap being opposed to the nozzle head when purging, wherein a deaerator is disposed in the main supply passage connecting the main tank and the back pressure tank and the back pressure tank is connected to an upstream of the purge pump in the recovery passage via a three way directional control valve.

The present invention also provides in a second form of implementation thereof an ink furnishing unit in an ink jet recorder as described above, wherein a potential head in the back pressure tank is adjustable relative to the nozzle head by adjusting the back pressure tank in its vertical position.

The present invention further provides in a third form of implementation thereof an ink furnishing unit in an ink jet recorder as described above, wherein the main tank is provided with a thermostat device for maintaining the ink at a predetermined temperature.

According to the first form of implementation, the purge pump is driven and at the same time the three way directional control valve is switched to communicate with the back pressure tank during printing operation or after termination of purging operation while the ink furnishing unit is at a halt whereby a portion of ink in the back pressure tank and a portion of ink recovered from the purge section and stored in the recovery tank are circulated together with a portion of ink in the main tank and all the portions of ink in the meantime are deaerated by the deaerator provided for the main supply passage and then reserved in the back pressure tank. This permits efficiently deaerating the entire ink to be furnished to the nozzle head, the entire ink including the ink recovered from the purge section.

Consequently, in a printing operation to be performed thereafter, the deaerated ink can be furnished from the back pressure tank, making it possible to favorably print with the nozzle head in the ink furnishing unit.

Also, according to the first form of implementation, since the ink circulation can be effected at any time when the apparatus is brought to a halt, if while the apparatus is at a halt for an extended period of time, ink in the back pressure tank open to the air has air (oxygen) dissolved therein from its surface, the dissolved air in the back pressure tank can be occasionally removed.

And, the apparatus according to the present invention can be constructed very simply because it only requires a bypass passage and a three way directional control valve to be added to the existing ink furnishing unit.

Also, according to the second form of implementation of the invention, the potential head of the back pressure tank with respect to the nozzle head can be adjusted as desired and the ink supply pressures at the times of ink filling, purging, printing and wiping in the nozzle head can be controlled with precision.

Further, according to the third form of implementation of the invention, since the ink in the main tank is maintained at a predetermined temperature by the thermostat device, the ink circulated through the ink supply passage is maintained at the predetermined temperature, so that the ink can be discharged through the nozzle head stably.

BEST MODES FOR CARRYING OUT THE INVENTION

Figure 1:
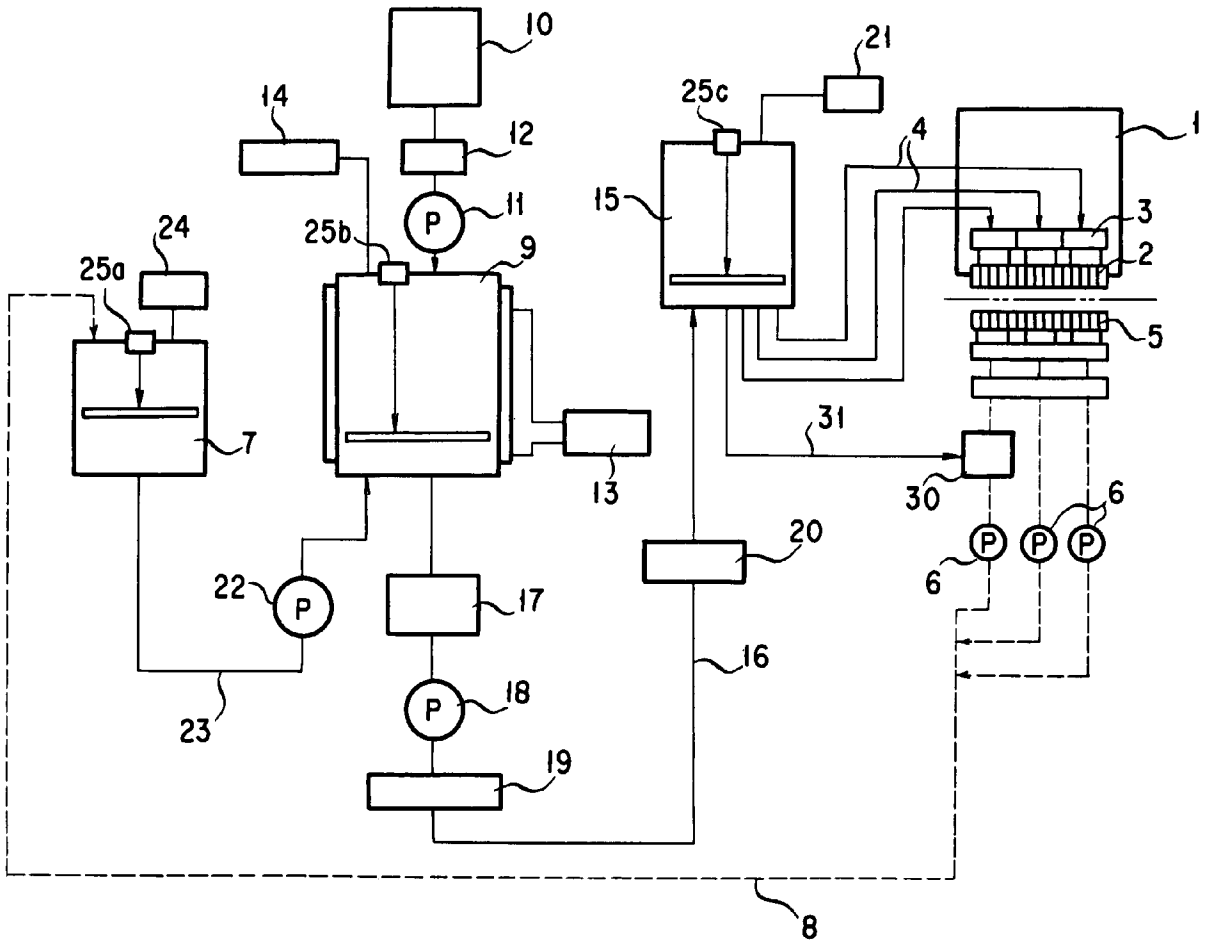
FIG. 1 is a circuit diagram illustrating the ink furnishing system of an ink furnishing unit in accordance with the present invention.

FIG. 1 diagrammatically shows an ink furnishing unit in an ink jet recorder in accordance with the present invention.

In the Figure, a head box 1 in the ink jet recorder is shown in which a nozzle head 2 having numbers of ink nozzles faces downwards. The nozzle head 2 is provided with an ink chamber 3 furnished with ink via an ink supply passage 4 and is designed to cause the ink to be discharged by the action of a drive such as piezo element (electromechanical transducer), thereby printing as desired on a sheet of paper (medium on which to record) traveling along a lower surface of the head box 1.

Figure 2:
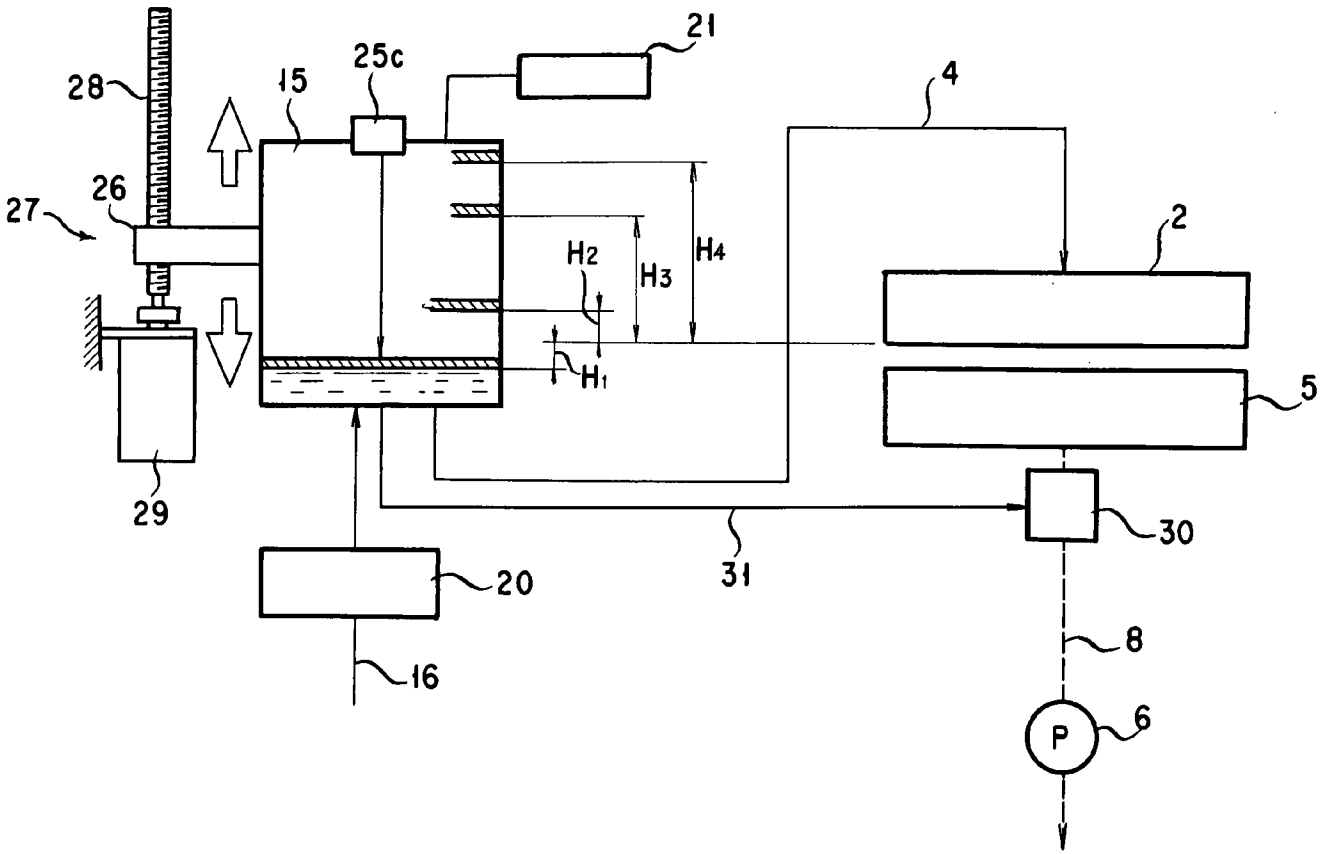
FIG. 2 is an explanatory view diagrammatically illustrating a support structure for a back pressure tank in the ink furnishing unit.

Numeral 5 designates a purge cap sized to cover the nozzle head 2 of the head box 1. The purge cap 5 in a standby state of the ink jet recorder in which the head box 1 has been moved to its maintenance position is opposed to its lower surface and pressed against the nozzle head 2 to purge the ink. Numeral 6 denotes purge pumps such that the ink purged thereby is recovered in to a recovery tank 7 with a recovery passage 8. While in FIG. 1 three purge pumps 6 are used in the embodiment shown, as shown in FIG. 2 a single purge pump 6 may be sufficient to be disposed in a single recovery passage 8 as shown connected to the purge cap 5.

In the Figure, numeral 9 indicates a main tank for reserving ink replenished from an ink pack 10 via an ink filter 12 by a supply pump 11. The main tank 9 is provided with a thermostat device 13 for maintaining the ink in the main tank 9 at a preset temperature. The main tank 9 is here open to the air via an air filter 14 and the thermostat device 13 has its preset temperature adjustable.

Numeral 15 designates a back pressure tank for furnishing the nozzle head 2 in the head box 1 with ink via the ink supply passage 4. The back pressure tank 15 is connected to the main tank 9 via a main supply passage 16. And, the main supply passage 16 is provided with a deaerator 17 for removing entrained air from the ink flowing through the main supply passage 16, a main ink pump 18, an ink filter 19 and a main ink supply electromagnetic valve 20 connected in series. The back pressure tank 15 is here open to the air via an air filter 21. Incidentally, the main ink supply electromagnetic valve 20 may be omitted in case there is no likelihood for the main ink pump 18 to cause any backflow.

The recovery tank 7 is connected to the main tank 9 via a return passage 23 provided with an ink pump 22 midway therein. The recovery tank 7 is here open to the air via an air filter 24.

The recovery tank 7, the main tank 9 and the back pressure tank 15 are provided with an ink amount sensor 25*a*, 25*b*, 25*c* for detecting the upper and lower limits of an amount of ink in the tank 7, 9, 15, respectively.

And, as for the main tank 9, depending on a value of the ink residual amount therein detected by the ink amount sensor 25*b*, namely if the ink residual amount therein becomes less than a preset value (lower limit), the supply pump 11 and/or the return pump 22 are driven to furnish the main tank 9 with virgin ink from the ink pack 10 and/or recovery ink from the recovery tank 7, simultaneously or selectively. And, when the upper limit of ink amount is detected, the ink ceases to be furnished.

Also, as for the back pressure tank 15, depending on a value of the ink residual amount therein detected by the ink amount sensor 25*c*, namely if the ink residual amount therein becomes less than a preset value (lower limit), the main ink supply electromagnetic valve 20 is opened and the main ink pump 18 is driven to furnish the back pressure tank 15 with ink from the main tank 9. And, when the upper limit of ink amount is detected, the ink ceases to be furnished.

The back pressure tank 15 as shown in FIG. 2 is supported by a tank lifting device 27 via a bracket 26. The tank lifting device 27 comprises a screw 28 vertically screwed through the bracket 26 and a motor 29 for rotating the screw 28 normally and reversely. Thus, with the motor 29 rotating normally and reversely, the back pressure tank 15 is moved up and down so that the potential head of the ink level in the back pressure tank 15 can be adjusted relative to the printing face of the recording head 1.

And, the potential head can then be set at values $H_1$, $H_2$, $H_3$ and $H_4$ selectively which are suitable at the times of printing, of the wiping in which the surface of the nozzle head 2 is wiped, of purging and of initial filling, respectively.

Then, it is necessary that the potential head $H_4$ at the time of the initial filling in which ink is filled in the ink supply passage 4 between the back pressure tank 15 and the nozzle head 2 by drawing air in the ink supply passage be the highest and that the potential head $H_3$ at the time of the purging in which when printing is to be reinitiated after the lapse of a small idle period after printing, mixed foreign particles and solid ink and entrained air are removed to substitute with fresh ink be close in pressure to the potential head $H_4$ at the time of initial filling.

Also, during the printing operation, the ink pressure with respect to the nozzle head 2 should properly be negative and the potential head $H_1$ is then made lower than at the printing face of the nozzle head 2. On the other hand, the potential head H2 during the wiping operation is made somewhat on the positive side. An example of these potential heads is as follows: the potential head $H_1$ at the time of printing is roughly −30 mm, the potential head $H_2$ at the time of wiping is roughly 20 mm, the potential head $H_3$ at the time of purging is 70±30 mm and the potential head $H_4$ at the time of initial filling is roughly 300 mm.

Upstream of the purge pump 6 in the recovery passage 8, the recovery passage is provided with three way electromagnetic valve (directional control valve) 30 to whose third port (bypass port) is connected with a bypass passage 31 connected to the back pressure tank 15. The three way electromagnetic valve 30 and the purge pump 6 are operable by a control unit (not shown) to perform different switching operations depending on three states of the ink jet recorder, i.e., if it is in printing operation, if it is at a halt and if it is in purging operation, respectively.

To with, when the ink jet recorder is in printing operation, the three way electromagnetic valve 30 in response to sensing by the ink amount sensor 25*c* at a preset time interval is switched to a bypass position and the purge pump 6 is driven to circulate ink. The purge pump 6 is then controlled by a detected value of the ink amount sensor 25*c* for the back pressure tank 15 so that it is brought to a halt when the lower limit of ink amount is detected and it is driven when the upper limit of ink amount is detected.

On the other hand, in the state that the printing operation is ended, the three way electromagnetic valve 30 after the purge cap 5 is opposed to and pressed against the nozzle head 2 in the ink jet recorder is switched to a purge position and the purge pump 6 is driven over a preset time duration to purge the nozzle head 2 of ink and to recover the ink to the recovery tank 7.

And, in this printing halt state and after the lapse of a preset period of time following the termination of the purging action, the ink is circulated as in the above-mentioned printing operation.

In the makeup mentioned above, during printing operation of the ink jet recorder, ink from the back pressure tank 15 is discharged through the nozzle head 2 to perform the printing. The amount of ink in the back pressure tank 15 is detected by the ink amount sensor 25*c*. In accordance with an amount of ink consumption, namely, when the lower limit of an ink amount is detected by the ink amount sensor 25*c*, the main pump 18 is actuated and at the same time the main ink supply electromagnetic valve 20 is opened to furnish ink from the main tank 9. When the upper limit of ink amount is detected, the main pump 18 is de-actuated and the main ink supply electromagnetic valve 20 is closed to cease furnishing ink. The ink then furnished from the main tank 9 is maintained at a predetermined temperature by the thermostat device 13. Also, the total amount of ink from the main tank 9 for supply into the back pressure tank 15 is passed through the deaerator 17 and thereby deaerated.

And, during printing operation, at preset time intervals ink is circulated for a predetermined time period as mentioned above.

While ink is being circulated during printing operation, a portion of ink in the back pressure tank 15 is furnished into the ink nozzle 2 and is not much as its feed rate is proportional to the rate of printing and a large part of ink in the back pressure tank 15 is recovered into the recovery tank past the recovery passage 8 from the bypass passage 31. And, when the amount of ink in the back pressure tank 15 is reduced to reach its lower limit, this is detected by the ink amount sensor 25*c* to de-actuate the purge pump 6 and at the same time to open the main ink supply electromagnetic valve 20 and to drive the main ink pump 18 so that ink from the main tank 9 is furnished into the back pressure tank 15 until it reaches its upper limit. The upper limit is sensed by the ink amount sensor 25*c* and after a predetermined time period of printing the purge pump 6 is again driven; the above operations are repeated.

By this ink circulation, ink in the back pressure tank 15 during printing operation is circulated to pass through the back pressure tank 15, the recovery tank 7 and the main tank 9 at preset time intervals. In the meantime, ink in the back pressure tank 15 is deaerated by the deaerator 17 and maintained at a predetermined temperature by the thermostat device 13 in the main tank 9.

Consequently, since ink furnished to the nozzle head 2 for printing is deaerated and maintained at a predetermined temperature in this manner, ink can be discharged through the ink nozzle stably.

The amount of ink in the main tank 9 is detected by the ink amount sensor 25*b* so that ink is supplied by the supply pump 11 or the return pump 22 in accordance with an amount of ink consumption.

During this printing operation, the supply pressure of ink discharged from the nozzle head 2 is derived from a differential pressure between the nozzle head 2 and the potential head of ink in the back pressure tank 15 and a pressure created by capillarity. And, the potential head of ink is adjusted so that as shown in FIG. 2, it has value $H_1$ at the time of printing, value $H_2$ at the time of wiping, $H_3$ at the time of purging and $H_4$ at the time of initial filling, which are optimum values at the times of the respective operations, by adjusting the height of the back pressure tank 15 by the lifting device 27.

When in the standby stage and also in purging, the head box 1 is moved to a maintenance or the like position at which the purge cap is opposed to and pressed against the lower surface of the head nozzle 2 and the purge pump 6 is driven. And, the three way electromagnetic valve 30 is then switched to a position at which the purge cap 5 communicates with the recovery passage 8.

Consequently, in this purging, ink is drawn from the nozzle head 2 towards the purge cap 5 and recovered into the recovery tank 7 through the recovery passage 8. Then (at the time of purging), in the presence of the potential head $H_3$ with respect to the nozzle head 2, ink in the nozzle head 2 and in the ink supply passage 4 is drawn together with air bubbles existing in the nozzle head 2 and in the ink supply passage 4. And, this purging operation is performed for a predetermined purging time period and terminated when the purge pump 6 is de-actuated.

After the lapse of a preset period (e.g., 1 minutes to 3 hours) after the above purging operation terminates or after the apparatus comes to a stop with taking account of such purging time, the purging pump 6 is driven again and at the same time the three way electromagnetic valve 30 is switched to its bypass position to circulate ink intermittently or continuously while deaerating ink and maintaining ink at a predetermined temperature in the standby stage after termination of purging.

While in the forms of implementation described above the electromagnetic valve is shown used as a directional control or change valve for connecting switchably to the bypass passage 31 and to the recovery circuit 8, any three way directional control or change valve may be used that is structurally different from an electromagnetic valve.

What is claimed is:

1. An ink furnishing unit in an ink jet recorder, comprising:

a back pressure tank connected to a nozzle head via an ink supply passage, a main tank connected to the back pressure tank via a main supply passage provided with a main ink pump therein, a recovery tank connected to the main tank via a return passage provided with an ink pump therein and a purge cap connected to the recovery tank via a recovery passage provided with a purge pump therein, said purge cap being opposed to the nozzle head when purging, characterized in that:

a deaerator is disposed in the main supply passage connecting the main tank and the back pressure tank and the back pressure tank is connected to an upstream of the purge pump in the recovery passage via a three way directional control valve.

2. An ink furnishing unit in an ink jet recorder as set forth in claim 1, characterized in that a potential head in the back pressure tank is adjustable relative to the nozzle head by adjusting the back pressure tank in its vertical position.

3. An ink furnishing unit in an ink jet recorder as set forth in claim 2, characterized in that the main tank is provided with a thermostat device for maintaining the ink at a predetermined temperature.

4. An ink furnishing unit in an ink jet recorder as set forth in claim 1, characterized in that the main tank is provided with a thermostat device for maintaining the ink at a predetermined temperature.

* * * * *